United States Patent [19]

Matsui et al.

[11] 3,964,725

[45] June 22, 1976

[54] DENTAL CHAIR

[75] Inventors: Takahiro Matsui; Osamu Uwamori, both of Kyoto, Japan

[73] Assignee: Kabushiki Kaisha Morita Seisakusho, Kyoto, Japan

[22] Filed: Apr. 5, 1974

[21] Appl. No.: 458,222

[30] Foreign Application Priority Data

Apr. 17, 1973 Japan ..... 48-43369

[52] U.S. Cl. ..... 248/421; 297/348

[51] Int. Cl.[2] ..... A61G 15/00

[58] Field of Search ..... 297/345, 347, 348, 330; 248/421, 422; 254/122, 126; 182/158

[56] References Cited

UNITED STATES PATENTS

| | | | |
|---|---|---|---|
| 487,039 | 11/1892 | Volz | 254/126 X |
| 575,684 | 1/1897 | Baxter | 297/348 X |
| 1,769,140 | 7/1930 | Kaufman | 248/421 X |
| 2,396,034 | 3/1946 | Baker | 182/158 |
| 3,116,910 | 1/1964 | Moore | 254/126 |
| 3,472,488 | 10/1969 | Naughton | 297/347 X |
| 3,486,583 | 12/1969 | Wiklund | 254/122 |
| 3,522,925 | 8/1970 | Buchtel | 248/421 X |

*Primary Examiner*—Francis K. Zugel
*Attorney, Agent, or Firm*—Christensen, O'Connor, Garrison & Havelka

[57] ABSTRACT

A dental chair which comprises a base; a first raising and lowering mechanism on said base; a member to be selectively raised and lowered by said mechanism; a second raising and lowering mechanism carried by said member; and a seat carried by said second mechanism to be selectively raised and lowered thereby.

3 Claims, 3 Drawing Figures

DENTAL CHAIR

This invention relates to a dental chair which is vertically movable with a patient being seated therein.

Generally, dental chairs are provided with a seat the height of which is vertically adjustable so as to bring the mouth of a patient seated therein into a position most convenient and suitable for the dentist to perform treatment. In most conventional dental chairs, a telescopic mechanism has been widely used to raise or lower the chair seat. The mechanism comprises a plurality, say, two concentrically arranged hollow cylinders so that the inner cylinders can slide axially relative to the outer cylinder. The inner cylinder supports a chair seat on top thereof and can be moved to such an extent that it is not pulled out of the outer cylinder.

When the inner cylinder is moved to this uppermost position, the seat thereon is raised to a height corresponding to the sum of the lengths of the inner and outer cylinders. When the seat is lowered to the lowest position, the seat is at the height corresponding to the length of the outer cylinder, provided that the outer cylinder is the longest of all the cylinders constituting the telescopic mechanism.

Recent technical developments in dental treatment require that the lowest position of the seat of the dental chair be as low as possible while the highest position thereof be as high as possible. With the previously mentioned telescopic raising and lowering mechanism, however, the highest and lowest positions of the chair seat are determined by the number and length of the cylinders employed. In order to increase the maximum height of the chair seat, the length and/or the number of the cylinders may be increased. However, if longer cylinders are used, the lowest position of the seat becomes higher. If many cylinders are used, the outermost cylinder must be of such a great diameter as to enclose all the inner cylinders, so that the telescopic mechanism becomes bulky.

In order to decrease or lower the lowest position of the chair seat, the length of the cylinders may be shortened. However, in order to increase the highest position of the seat with such short cylinders, it is necessary to use many cylinders, with resulting increase in the size of the whole mechanism.

Thus, with the conventional telescopic system it is impossible to increase the maximum height of the seat and at the same time decrease the minimum height thereof without increasing the size of the whole mechanism.

Accordingly, one object of the invention is to provide a dental chair having a seat raising and lowering mechanism which is relatively small in size.

Another object of the invention is to provide a dental chair having a seat raising and lowering mechanism which is capable of raising and lowering the seat to a higher and a lower position than in the prior art chairs of similar types.

Another object of the invention is to provide a dental chair having a seat raising and lowering mechanism which is so designed and constructed that the mechanism is in the most contracted condition when the seat is at the lowest position thereof.

Another object of the invention is to provide a dental chair having a seat raising and lowering mechanism which comprises two different mechanisms which are operated in ganged relationship to each other so as to effect raising or lowering of the chair seat.

Another object of the invention is to provide a dental chair having a seat raising and lowering mechanism which comprises two different mechanisms which are caused by a drive to operate simultaneously so as to effect raising or lowering of the seat more quickly than otherwise.

The seat raising and lowering mechanism of the invention comprises a linkage and a pair of slidable members to which are connected the lower ends of the links constituting the linkage, the upper ends of which support a chair seat. The links cross in the manner of the letter X, so that as the slidable members are moved in opposite directions to each other, the linkage expands or contracts, that is to say, the angle of the inclination of the links relative to the horizontal line increases or decreases, thereby causing the seat to be raised or lowered in parallel, that is to say, without substantial tilting or inclination of the seat from its horizontal position.

A frame supports the slidable members so that they are moved horizontally. The frame is vertically movable along a guide post standing upright on a base. As the drive for effecting the vertical movement of the frame a gear drive or fluid pressure may be used in any suitable known manner.

The slidable members are connected to the upper end of another linkage the lower end of which is secured to a fixed position of the base. This linkage is used to move the slidable members toward or away from each other as the previously mentioned frame is raised or lowered to change the distance between the frame and the fixed position of the base.

As the frame is vertically moved, the seat is accordingly raised or lowered, and the simultaneous movement of the slidable members relative to the frame causes the linkage supporting the seat to expand or contract thereby further raising or lowering the seat. This means that the simultaneous movement of the frame and the linkages cause the seat to move more quickly than otherwise.

The linkage interposed between the seat and the vertically movable frame can be a parallel linkage so as to keep the seat at a substantially horizontal position without tilting or inclination as it is raised or lowered.

Such a parallel linkage may comprise a pair of parallel links having their upper ends pivoted to the chair seat and their lower ends pivoted to the slidable member in such a manner that the line connecting the two pivot points of the links on the chair seat is parallel with the line connecting the two pivot points of the links on the slidable member.

The invention will be described in further detail with reference to the accompanying drawings wherein.

Figure 1:
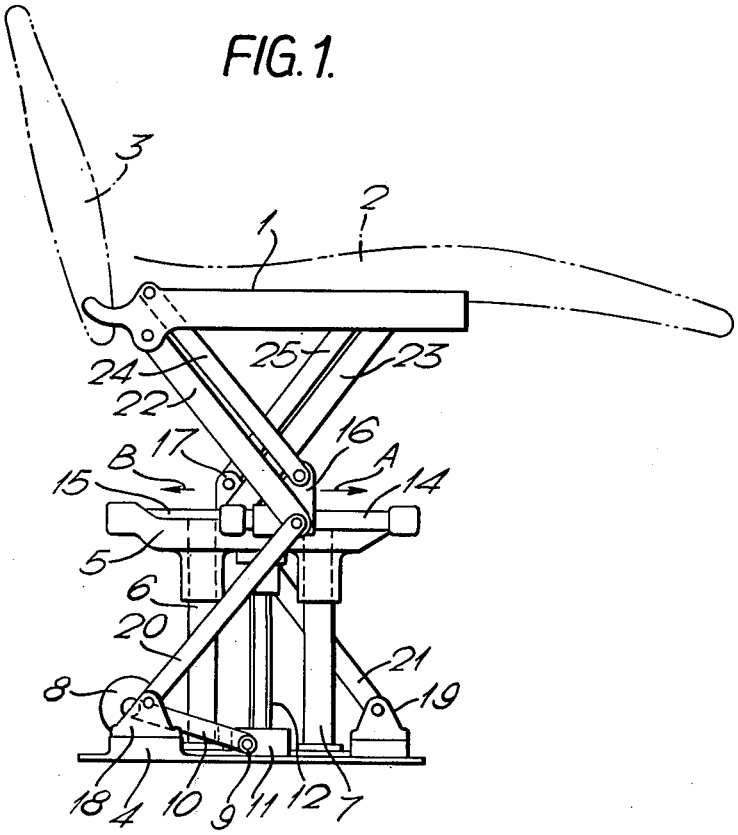
FIG. 1 is a side elevation of the dental chair of the invention with its seat shown at the highest position thereof.

Referring in detail to the drawings, there is shown a chair seat 1 supporting a cushion 2 thereon with a back 3 attached to the seat in a usual manner.

A base 4 is fixed to the floor of a room in which the chair is installed. A pair of vertical guide posts 6 and 7 are secured to the base 4, and a movable frame 5 is supported by the posts so as to be vertically movable therealong.

In the illustrated embodiment, a gear mechanism (not shown) is employed to raise and lower the frame 5. An electric motor 8 securely attached to the base is used as a drive for the movement of the frame 5. The motor 8 rotates a pulley 9 through an endless belt 10. The pulley 9 rotates a gear not shown but enclosed in a gear box 11. The gear meshes with the lower end of a vertical externally threaded shaft 12 having its upper end rotatably connected to the bottom of the frame 5. As can be easily seen, when the gear in the box 11 is rotated, the shaft 12 is rotated.

Figure 3:
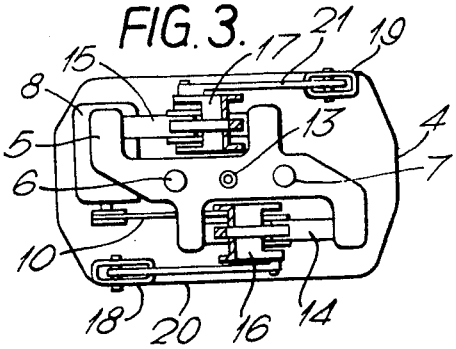
FIG. 3 is a top plan view taken along line III — III of FIG. 1.

The externally threaded shaft 12 passes through an internally threaded bore 13 (FIG. 3) provided on the frame 5, so that as the shaft 12 is rotated, the frame is vertically moved along the guide posts 6 and 7 in the direction, that is upwardly or downwardly, as determined by the direction of rotation of the threaded shaft.

A pair of horizontally extending parallel rods 14 and 15 are provided on the frame 5. A slidable block 16, 17 is carried by each of the rods 14 and 15.

A link element 20 has its lower end pivoted to a stationary block 18 fixed to the base and its upper end pivoted to the slidable block 16. In a similar manner, a link element 21 has its lower end pivotally connected to a stationary block 19 fixed to the base and its upper end pivoted to the slidable block 17. The two link elements 20 and 21 are oppositely inclined.

As the frame 5 is raised or lowered in the above-mentioned manner, the link elements are raised or lowered as they rotate in opposite directions about the pivot connections to the stationary blocks 18 and 19, respectively.

As the frame 5 rises, the distance between the frame and the base increases. However, since the length of the link elements 20 and 21 does not change, the link elements rise so as to keep constant the distance between the slidable blocks 16, 17 and the stationary blocks 18 and 19. This means that the slidable blocks 16 and 17 slide along the rods 14 and 15 toward a position immediately above the stationary blocks 18 and 19, respectively. In other words the slidable blocks 16 and 17 horizontally move toward each other.

Between the slidable blocks 16, 17 and the chair seat 1 there is provided another linkage which comprises a pair of link elements 22 and 23 having their lower ends pivotally connected to the slidable blocks 16 and 17, respectively, and their upper ends pivotally connected to the chair seat. Just as in the case with the link elements 20 and 21, the links 22 and 23 are inclined in opposite directions to each other. In the illustrated embodiment the link element 22 which has its lower end pivoted to the slidable block 16 which moves forwardly of the chair when the seat is lowered has its upper end pivoted to the rear side of the chair seat, while the link 23 which has its lower end pivoted to the slidable block 17 and which moves rearwardly of the chair when the seat is lowered has its upper end pivoted to the front side of the chair seat.

Since the distance between the front and rear pivots of the link elements 22 and 23 to the seat is constant, if the slidable blocks 16 and 17 are blocked, the chair seat with a load imposed thereon cannot be lowered. However, when the slidable blocks 16 and 17 move in the directions of arrows A and B, respectively, as the frame 5 is lowered, the seat 1 is also lowered. When the slides move in the directions opposite to the arrows A and B as the frame 5 is raised, the seat is also raised.

In order that the position of the chair seat may remain horizontal as the seat is raised or lowered, and also in order that the seat may not be inclined or tilted forwardly or rearwardly from its substantially horizontal position as the seat is raised or lowered, it is desirable that the linkage connecting the seat to the slide blocks 16 and 17 should be parallel linkage.

In the illustrated embodiment, a second link element 24 is provided in parallel with the link element 22 and has its upper and lower ends pivoted to the seat 1 and the slidable block 16, respectively. The straight line between the pivot points of the link elements 22 and 24 to the seat 1 is parallel with the straight line between the pivot points of the link elements to slidable block 16. The same is true with a second link element 25 which is provided in parallel with the link element 22 and which has its upper and lower ends pivoted to the seat 1 and the slidable block 17, respectively.

It will be easily seen that by the use of the parallel linkage the seat 1 can be maintained at the proper horizontal position without being tilted at the front or back side as the seat is raised or lowered.

FIG. 1 shows the chair with its seat 1 at the highest possible position. Suppose that the motor 8 is energized to rotate the shaft 12 so as to lower the frame 5. As the frame is lowered, the angle of the inclination of the link elements 20 and 21 decreases so that the links lie more and more horizontal, with the slidable blocks 16 and 17 moving on the rods 14 and 15 in the directions A and B, respectively, and the top ends of the posts 6 and 7 and the threaded shaft 2 projecting more and more above the frame 5 below the seat 1.

Figure 2:
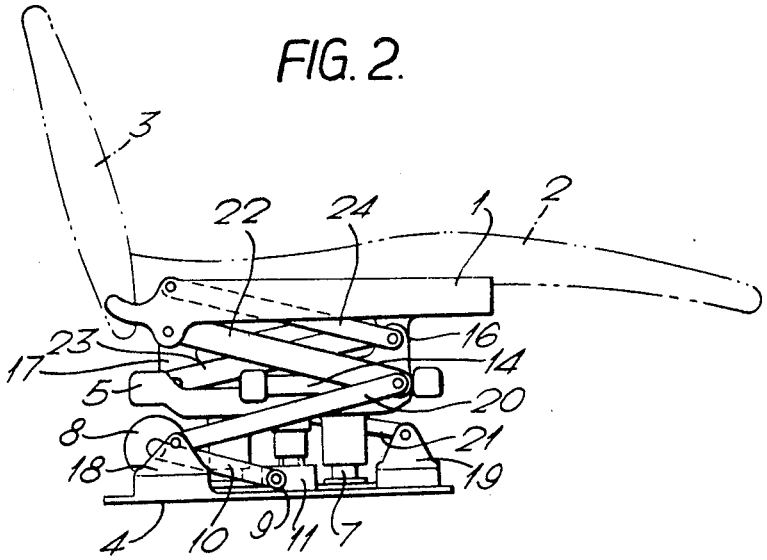
FIG. 2 is a view similar to FIG. 1 with its seat shown at the lowest position thereof.

As the slidable blocks 16 and 17 move in the directions A and B, the angle of inclination of the link elements 22, 24 and 23, 25 decreases so that the link elements lie more and more horizontal and the seat is lowered to approach the frame 5. Thus the seat is quickly lowered due to the lowering of the frame 5 and the simultaneous changing of the inclination of the link elements 22 – 25. FIG. 2 shows the lowest position to which the seat has been lowered in the above manner. It will be easily understood that in order to raise the seat 1 from the lowest position it will be necessary only to rotate the threaded shaft 12 in the direction opposite to that in the above case.

From the above description it is clear that the lowest position or height of the seat 1 is determined by the height or length of the guide posts 6 and 7. Therefore by selecting the length of the guide posts it is possible to decrease the lowest position of the seat, so that the length of the posts may be determined in accordance with the desired lowest height of the seat.

On the other hand, the highest position of the seat is determined by the length of the posts 6 and 7 and that of the link elements 22 – 25. Since the length of the posts is selected in accordance with the required lowest position of the seat, in order to have the highest position thereof as high as possible it will be necessary to employ as long link elements 22 – 25 as possible. Since the length of the links does not effect the lowest position of the seat, it is possible to determine the highest position of the seat regardless of the lowest position thereof.

Thus in accordance with the invention, it is possible to set the lowest and highest positions of the seat as low and high as is desired, without rendering the mechanism complicated or bulky. Since the raising and lowering of the seat is caused by the movement of the frame and the simultaneous movement of the linkage between the seat and the frame, the time required for the seat to be raised or lowered a desired distance can be decreased.

What we claim is:

1. A dental chair, comprising:

a base;

a seat for the dental chair;

first raising and lowering means carried by said base member;

a frame member supported by said first raising and lowering means so that said frame member is raised and lowered thereby; and, second raising and lowering means, said second raising and lowering means operative to raise and lower said seat and comprising, on each side of said chair, a first link means having two ends and a movable joint at a point therebetween, said first link means being rotatably connected at one end thereof to said base by pivot means fixed relative to said base and rotatably connected at the other end thereof to said seat by pivot means fixed relative to said seat, and, slidable supporting means carried by said frame for slidably supporting said movable joint such that said movable joint slides substantially horizontally along said slidable supporting means as said first raising and lower means raises and lowers said frame member, said seat being raised or lowered as said frame member is raised or lowered by an amount equal to the amount said frame member is raised or lowered plus an additional amount resulting from movement of said movable joint in said slidable supporting means;

one of said first link means being rotatably connected at one end thereof to said seat toward the rear thereof and the other of said first link means being rotatably connected at one end thereof to said seat toward the front thereof, said one of said first link means being rotatably connected to said base toward the rear thereof and said other of said first link means being rotatably connected to said base toward the front thereof, said slide members moving in opposite directions when said chair is raised or lowered.

2. A dental chair as claimed in claim 1, wherein each said slidable supporting means includes a slidable support assembly which comprises: a rod-like element, a slide member adapted to be supported by said rod-like element, and horizontally slidable therealong, and connecting means rotatably connecting said movable joint to said first slide member.

3. A dental chair as claimed in claim 2 wherein each of said first link means includes an upper and a lower link section each of said upper link sections having two ends and being rotatably connected at one end thereof to said seat and at the other end thereof to the slide members of their respective associated slidable support assemblies, each of said lower link sections having two ends and being rotatably connected at one end thereof to said base and at the other end thereof to the slide member of their respective associated slidable support assemblies, said upper and lower link sections of each of said first link means being oppositely inclined to each other, said upper link sections being oppositely inclined relative to each other, and said lower link sections being oppositely inclined relative to each other, the angle of each of said upper and lower link sections relative to the horizontal increasing as said frame member is raised.

* * * * *